United States Patent [19]

Shida et al.

[11] 4,162,627

[45] Jul. 31, 1979

[54] ROLLING MILL

[75] Inventors: Shigeru Shida; Toshiyuki Kajiwara, both of Hitachi, Japan

[73] Assignee: Hitachi, Ltd., Japan

[21] Appl. No.: 887,369

[22] Filed: Mar. 16, 1978

Related U.S. Application Data

[63] Continuation of Ser. No. 560,687, Mar. 21, 1975, abandoned, which is a continuation of Ser. No. 378,915, Jul. 13, 1973, abandoned.

[30] Foreign Application Priority Data

Jul. 17, 1972 [JP] Japan ..... 52-70817

[51] Int. Cl.[2] ..... B21B 31/18

[52] U.S. Cl. ..... 72/247

[58] Field of Search ..... 72/247, 243, 242, 6, 72/8

[56] References Cited

U.S. PATENT DOCUMENTS

| | | | |
|---|---|---|---|
| 3,076,360 | 2/1963 | Sendzimir | 72/242 |
| 3,818,743 | 6/1974 | Kajiwara et al. | 72/243 |

*Primary Examiner*—Milton S. Mehr

*Attorney, Agent, or Firm*—Craig and Antonelli

[57] ABSTRACT

A pair of upper and lower work rolls are supported by metal chocks provided with roll bending devices, and backup rolls are supported by metal chocks which may be movable in the axial direction. The backup rolls may be displaced in the axial direction so as to vary the length of line of contact between the work rolls and the backup rolls to control the distribution of rolling pressure transmitted from the backup rolls to the work rolls, whereby the sectional dimension may be controlled jointly using the bending forces of the work rolls.

3 Claims, 7 Drawing Figures

ROLLING MILL

This is a continuation of application Ser. No. 560,687, filed Mar. 21, 1975, abandoned, which is a continuation of Ser. No. 378,915, filed July 13, 1973, now abandoned.

BACKGROUND OF THE INVENTION

The present invention relates to generally a rolling mill and, more particularly, to a rolling mill with a novel roll arrangement.

DESCRIPTION OF THE PRIOR ART

In recent years, the requirement for accuracy in thickness of rolled products, particularly cold-rolled steel plates, is becoming more and more severe. To meet such requirements, the accuracy in thickness in the longitudinal direction of a strip has been increased to an appreciable extent owing to the rapid development of an automatic gauge control method; however, a method of effectively controlling the thickness in the widthwise direction of a strip has not yet been found. It has, of course, been known that work roll bending methods have been developed and used in a four-high rolling mill as a measure for controlling the flatness in the widthwise direction of a strip with considerably favorable results. However, in the conventional roll bending method, the flatness controlling effect or the so-called flatness correcting capacity is limited and is particularly insufficient when the width of the strip to be rolled varies largely, and a sufficiently satisfactory result cannot be obtained having become more apparent from the description set forth hereinbelow.

In general, in order to obtain rolled products which are satisfactory in shape, particularly in thickness in the widthwise direction, the following two factors are most important:

(1) to minimize the bending of the work rolls under rolling pressure, and (2) to increase the flatness correcting capacity of roll bending.

The phenomenon in which the work rolls are bent under rolling pressure is attributable to the fact that the opposite end portions of the work rolls which are not in contact with the strip being rolled are subjected to the bending moments caused by the contact load with backup rolls, and such phenomenon naturally causes a remarkable thickness unevenness of the strip near the boundary between the portions of the work rolls which are in engagement with the strip and the end portions of the same which are not in engagement with the strip, or at the opposite edge portions of the strip. The thickness unevenness becomes particularly greater as the width of the strip becomes narrower relative to the length of the work rolls because the bending moments become larger and the deflection of the work rolls becomes greater.

On the other hand, the effect of the roll bending method is largely influenced by the diameter of the work rolls. For instance, when the diameter of the work rolls is small, the roll bending action is restricted by the backup rolls and its effect appears only at the end portions of the rolls. Furthermore, since the roll bending force is subjected to a limitation by strength of the roll necks and the service life of the bearings, the adjustment of the roll bending effect is possible only within a limited range, and it is particularly difficult to change the roll crown as desired. After all, the initial crown of the rolls must be changed at each time the width of the strip changes as is being practiced at the present time. If such measure is not taken, it would be impossible to prevent the thickness unevenness in the widthwise direction of the strip, and this will result in a substantial degradation of the quality of the product.

However, in actual rolling mills, it is usual that the width of strips frequently changes and, if the rolls are exchanged each time the width changes, the working efficiency of the rolling mills would be greatly reduced. Additionally, a large number of rolls having different initial crowns must be provided, thereby increasing the number of spare rolls and, consequently, increasing the operational cost, thus resulting in an increase in the production costs.

SUMMARY OF THE INVENTION

One of the objects of the present invention is therefore to provide an improved rolling mill which may overcome the above and other related problems by the combination of the deflection of the work rolls due to the variation in width with the deflection thereof due to the variation in length of contact with the backup rolls.

According to one aspect of the present invention, both the upper and lower backup rolls are movable in the axial direction thereof so that the length of contact between the work and backup rolls may be varied. Therefore the rolling pressure transmitted from the backup rolls to the work rolls may be distributed only over a length of the work rolls in contact with a workpiece to be rolled (as if the length of the backup rolls were equal to the width of the workpiece to be rolled) so that the bending of the work rolls may be considerably reduced.

Another object of the present invention is to provide an improved rolling mill of the type described above and further comprising means for bending the work rolls so that the section dimensions may be controlled with a higher degree of accuracy. As described above, in the rolling mill in accordance with the present invention the backup rolls are movable so that one edge of one of the backup rolls may be aligned with one edge of the workpiece whereas one edge of the other backup roll may be aligned with the other side edge of the workpiece, but the other edges of the backup rolls extend beyond the side edges of the workpiece. Therefore in some cases the control of section dimensions is not satisfactory. To overcome this problem the work roll bending devices are added. Since one end portion of the work rolls is not supported by the backup rolls as described above, bending of the work rolls may be attained with less bending forces as compared with the conventional rolling mills. Especially when the width of a workpiece is narrower the bending of the work rolls may be facilitated so that the thickness in the transverse direction of a rolled product may be controlled with a higher degree of accuracy.

Another object of the present invention is to provide an improved rolling mill with a novel arrangement for moving the backup rolls in the axial direction.

In order that the backup rolls may be moved in the axial direction while they exert the extremely high rolling pressures to the work rolls, the conventional backup roll supporting arrangement would become large in size and complex in construction. In order to overcome this problem, the metal chocks of the backup rolls are mounted upon a rigid frame which is movable in the axial direction within the housing of the rolling mill. Alternatively the necks of the backup rolls may be so supported by the metal chocks as to be movable within the metal chocks.

The above and other objects, features and advantages of the present invention will become more apparent from the following description of preferred embodiments thereof taken in conjunction with the accompanying drawings.

DESCRIPTION OF THE PREFERRED EMBODIMENTS

Figure 1:
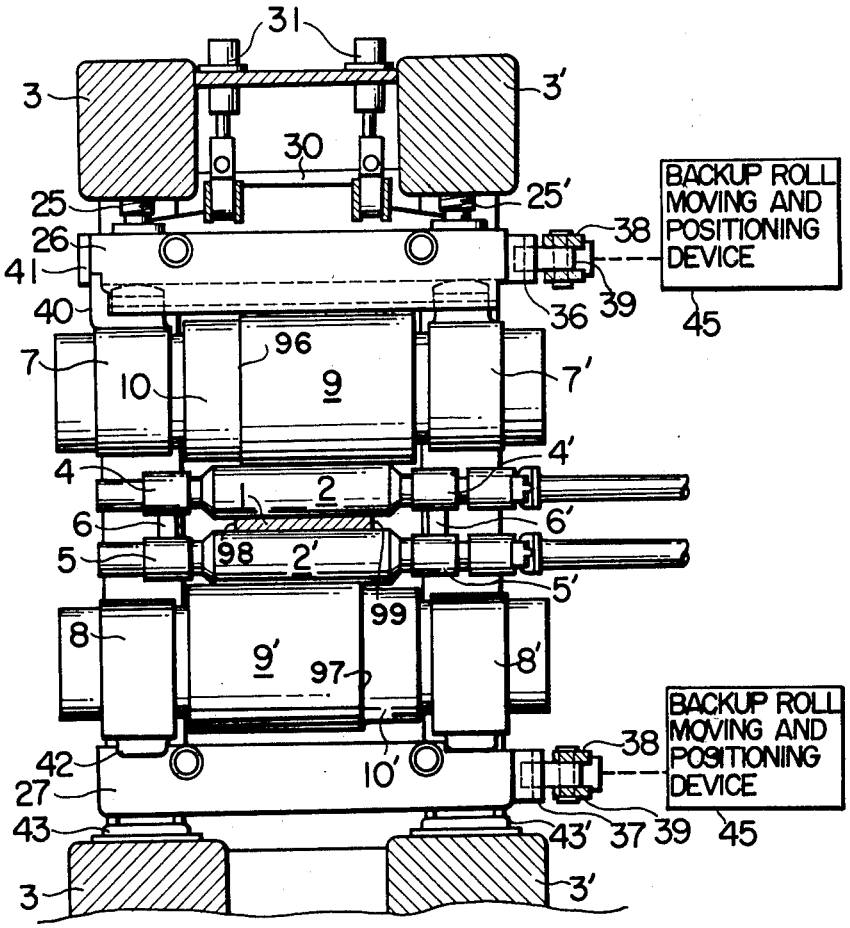
FIGS. 1 and 2 are a front view and a side view, respectively, of a first embodiment of the present invention.
Figure 2:
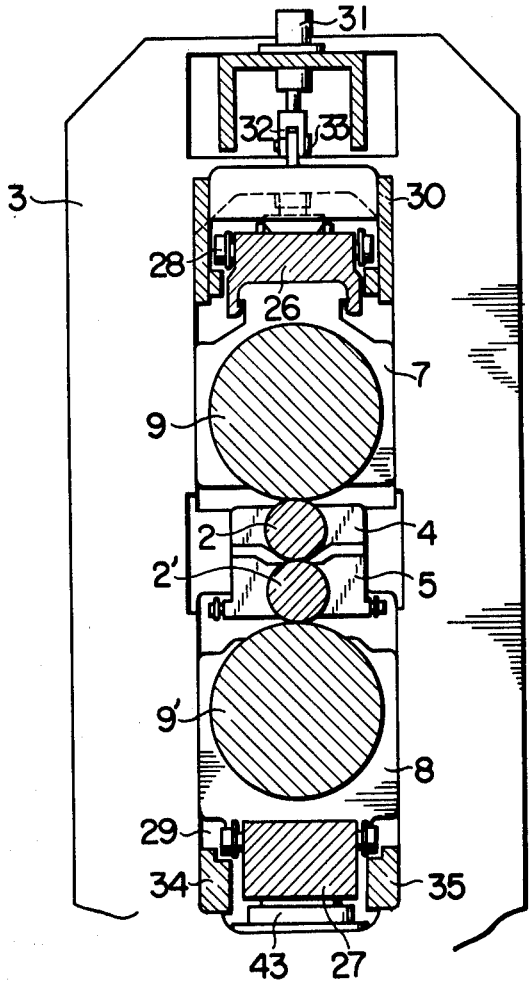

Referring to FIG. 1, a pair of upper and lower working roll 2 and 2', which rolls metal or stock 1, are supported by metal chocks 4 and 4' and 5 and 5', which in turn are securely held within a roll housing 3, in such a way that the pair of working rolls 2 and 2' may be vertically movable within the roll housing 3. Roll bending devices 6 and 6' are interposed between the pairs of metal chocks 4 and 5 and 4' and 5', respectively, so that the suitable bending forces may be exerted to the working rolls 2 and 2' in a conventional manner. A pair of backup rolls 9 and 9' have their ends supported by metal chocks 7, 7', 8, and 8' in such a way that they may be movable not only in the vertical direction within the housing 3 but also in the direction parallel with the axes of the working rolls 2 and 2'. One end portion of each the backup rolls 9 and 9' is shaped into the form of a cone or any other suitable form. In the instant embodiment, the left end 10 of the upper backup roll 9 has its diameter reduced whereas the right end portion 10' of the lower backup roll 9' is reduced in diameter. The upper metal chocks 7 and 7' are backed up by a frame 26 with high rigidity so that no excessive forces may be exerted to the roll bearings even when the center of the bearing is displaced from the center of each of compression screws 25 and 25' by the axial displacement of the backup roll 9.

An arm 40 for retaining the metal chock 7 in position is interposed between the frame 26 and a keeper plate 41 in order to permit a small vertical movement of the backup roll 9 and its frame 26 and to prevent the relative movement between them in the axial direction. In like manner the lower roll chocks 8 and 8' are backed up by a frame 27 with high rigidity, and the relative movement between the lower backup roll 9' and the frame 27 in the axial direction is prevented by a socket portion 42 of the frame 27.

When the backup roll 9 is to be moved in the axial direction, a clearance is provided between the compression screws 25 and 25' and the frame 26, and a carrier frame 30 is lifted by a lift cylinder 31 which is connected to the carrier frame 30 through a bifurcated member 32 and a connecting pin 33. Therefore the projections extending from the lower portion of the carrier frame 30 lift a shaft 28 and the frame 26. The upper backup roll 9, which is moved away from the working roll 2, is moved axially by a device 45 which moves the backup roll 9 and also serves to retain it in position and is connected through a hook 39 and a frame 38 to an engaging member 36 of the frame 26. In like manner, the lower backup roll 9' is moved in the axial direction by the backup roll moving and positioning device 45 after wheels 29 of the frame 27 are moved away from guide rails 34 and 35 by hydraulic jacks 43 and 43'.

Now the desired axial displacement of the backup rolls will be described. The working-side end 96 of the effective surface of backup roll 9 is positioned inwardly from the corresponding end of the effective surface of the work roll 2 and also in or close to the vertical plane including the corresponding edge 98 of the strip or stock 1 to be rolled, whereas the driving-side end 97 of the effective surface of the backup roll 9' is positioned inwardly from the corresponding end of the effective surface of the work roll 2' and also in or close to the vertical plane including the corresponding edge 99 of the strip 1. When this position is reached, the backup roll moving and positioning devices 45 are stopped and then the cylinders 31 are restored to their original position for lowering roll metal chocks 7, 7' and, hence, the backup roll 9. Thus, the backup roll 9 is brought into contact with the work roll 2 to hold the same. At this stage, the strip 1 is ready to be fed for rolling. When it is desired to change the width of the rolled product, the foregoing operation may be repeated until a desired axial contact length is attained between the backup rolls 9, 9' and the associated work rolls 2, 2'.

According to the present invention section dimensions can be controlled to very close tolerances in a very effective manner only by transversely moving the frames 26 and 27 and hence the backup rolls 9 and 9' by the mechanism which is very simple in construction.

Figure 3:
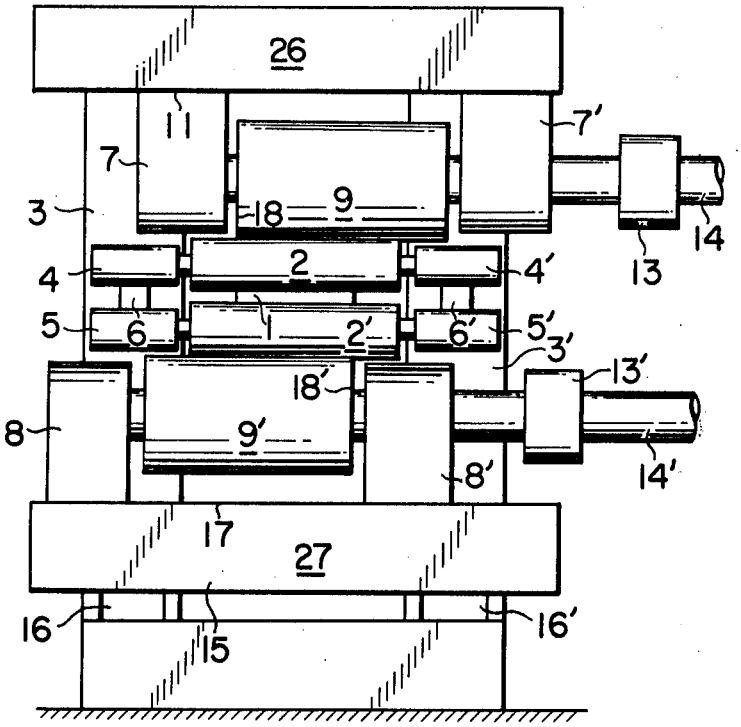
FIG. 3 is a front view of a second embodiment of the present invention.
Figure 4:
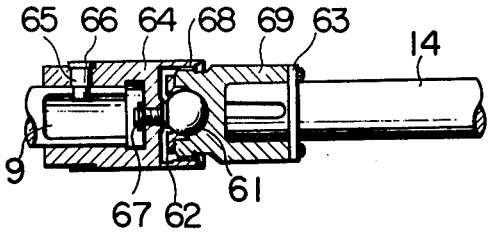
FIG. 4 is a sectional view of a universal coupling thereof.
Figure 5:
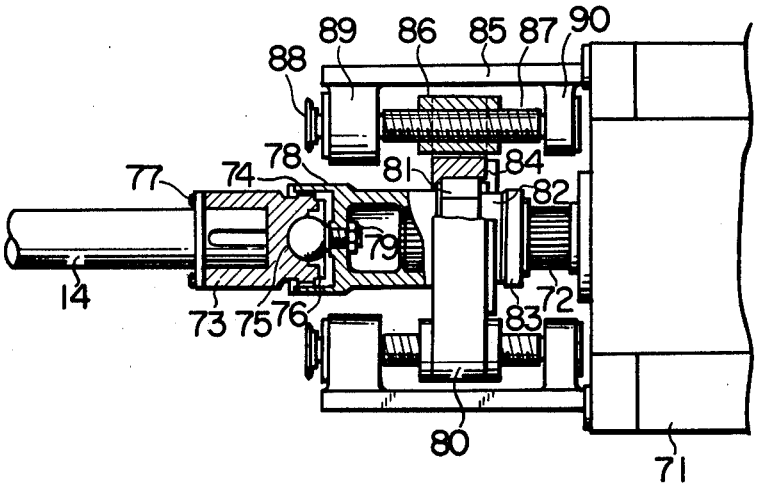
FIG. 5 is a sectional view illustrating the arrangement thereof adjacent to the pinion stand.

Second Embodiment, FIGS. 3, 4 and 5

Referring to FIGS. 3, 4 and 5 the second embodiment of the present invention will be described hereinafter. The upper and lower backup rolls 9 and 9' are coupled through couplings 13 and 13' to spindles 14 and 14', respectively, which in turn are drivingly coupled to a drive source (not shown) which not only rotates the upper and lower backup rolls but also moves them transversely or axially of the work rolls. The axial movement of the upper and lower backup rolls 9 and 9' may be effected independently of each other, and means (not shown) are provided in order to detect the axial displacement of the backup roll. The axial thrusts exerted to the backup rolls 9 and 9' are received by pinion stands 71 (see FIG. 5) of the spindle 14 and 14'.

Since the couplings 13 and 13' are substantially similar in construction, it will suffice to explain the coupling 13 with reference to FIG. 4. The coupling 13 generally comprises an inner sleeve 69, an outer sleeve and a coupling member 61 with a spherical head. The inner sleeve 69 is securely fixed with bolts and nuts to a flange 63 which is shrink-fitted over the spindle 14, and the outer sleeve 64 is securely fixed to the upper backup roll 9 with pins 65 and a ring 66. The inner and outer sleeves 69 and 64 are rotatably coupled through gears 68 and by the coupling member 61 with a retainer 62 and a nut 67.

As shown in FIG. 5, the spindle 14 is coupled through a universal joint similar to that shown in FIG. 4 to a splined output shaft 27 journalled by the pinion stand 71 and drivingly coupled to a motor (not shown).

The universal coupling generally comprises an inner sleeve 73, an outer sleeve 78, and a coupling member 75 with a spherical head. The inner sleeve 73 is securely fixed with bolts and nuts to a flange 77 which in turn is shrink-fitted over the spindle 14, and the outer sleeve 78 is securely fixed to the output shaft 72. The inner and outer sleeves 73 and 78 are rotatably coupled through gears 74 and by the coupling member 75 with a retainer 76 and a nut 79. A thrust bearing 81 with a casing 80 and a cover 84 is fitted over the outer sleeve 78 with a collar 82 and a nut 83 in such a manner that the axial movement of the thrust bearing 81 may be prevented. A screw 87, both ends of which are rotatably journalled by a pair of horizontally spaced apart downwardly depending members 89 and 90 of a frame 85, has a sprocket wheel 88, which is drivingly coupled to a motor (not shown) and a nut 86 fitted over the screw 87 and in mesh with the casing 80.

According to the second embodiment the axial movement and rotation of the backup roll may be made by the common spindle 14 so that the construction may be simplified and the maintenance may be much facilitated.

Figure 6:
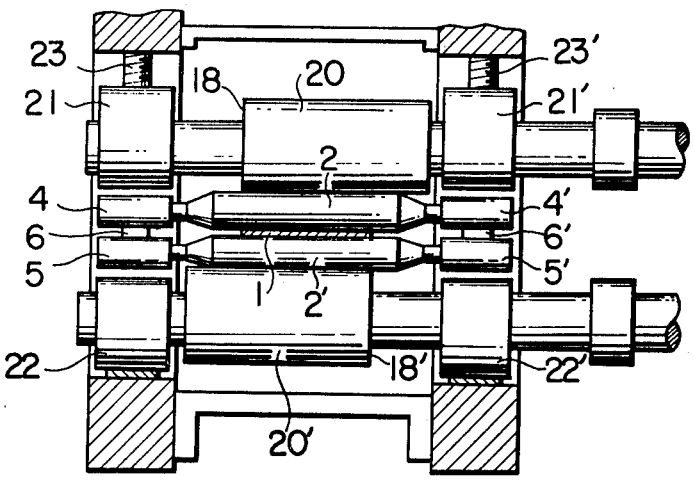
FIG. 6 is a front view, partly in section, of a third embodiment of the present invention.

Third embodiment, FIG. 6

The third embodiment shown in FIG. 6 is different from the second embodiment described hereinbefore with reference to FIGS. 3–5 only in that the metal chocks 21, 21', 22 and 22' of the upper and lower backup rolls 20 and 20' are so disposed that they are not permitted to move in the axial direction but the rotation and the axial movement of the backup rolls may be permitted, so that the relative position between the reduction screws 23 and 23' and the metal chocks 21 and 21' remains unchanged. The mode of operation of the third embodiment is substantially similar to that of the first and second embodiments described hereinbeforewith reference to FIGS. 1–5 so that no description will be made in this specification.

When the backup rolls 9 and 9' or 20 and 20' are moved in the axial direction in such a manner that the end faces 18 and 18' of the backup rolls may be aligned with the side edges of the strip 1, not only the bending of the working rolls 2 and 2' due to the rolling load may be reduced, but also the bending effect of the roll bending devices 6 and 6' may be much enhanced so that the strip whose section dimensions finished to close tolerances may be obtained.

The advantages of the rolling stand of the present invention over the conventional rolling stand may be clearly understood from the table below:

| | The reduction ratios | |
|---|---|---|
| | Reduction ratio (%) | Optimum bending force (ton) |
| A | 5 | 2.5 |
| B | 10 | 0.5 |
| C | 20 | 1.0 |
| D | 30 | 1.5 |

where A shows the case of the conventional four-stand rolling mill, whereas B, C and D show the cases of the rolling mills of the present invention.

The reduction ratios and the optimum bending forces shown in the above table were the data when the strip with the optimum section dimensions was produced. In all cases, the working rolls with a diameter of 130 mm and the backup rolls with a diameter 300 mm were used, and the length of the working and backup rolls was 300 mm. The width of the strip was 150 mm, and the working rolls were not provided with an initial crown.

From the above table it is seen that in case of the conventional rolling mill the reduction ratio was only 5% even when the bending force was as high as 2.5 tons. When the reduction ratio is increased, the edge drop phenomenon will inevitably occur, and unless the working rolls are provided with an initial crown it is impossible to roll with a reduction ratio between 10 and 30%. However in case of the rolling mills of the present invention, the reduction ratio may be remarkably increased with the optimum bending force being reduced.

Figure 7:
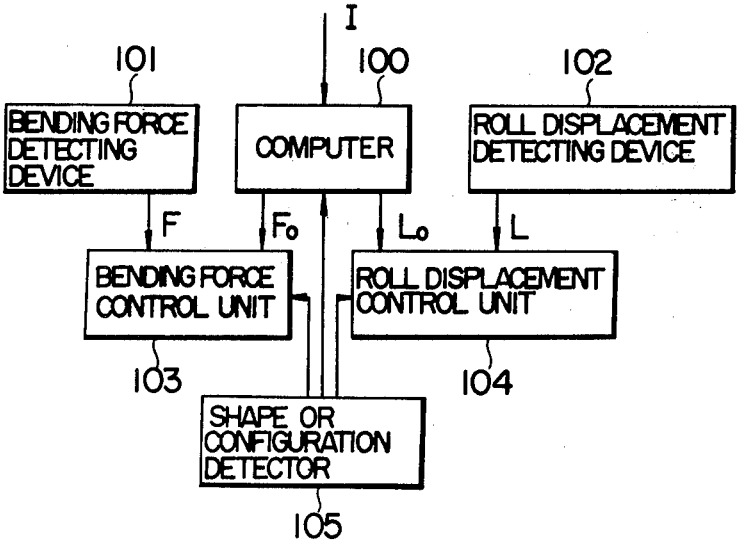
FIG. 7 is a block diagram of a control system of a rolling mill in accordance with the present invention.

Control system, FIG. 7

The control system of the rolling mills of the present invention will be described hereinafter with reference to FIG. 7. Depending upon information about the compositions of steel to be rolled, section dimensions, reduction ratio and so on, the optimum bending force Fo and the optimum axial displacement Lo obtained from a computer 100 are set. Alternatively, a bending force control unit 103 as well as a roll displacement control unit 104 are actuated in response to the comparison of the optimum values Fo and Lo with the signals F and L derived from a bending force detecting device 101 and a roll displacement detecting device 102, respectively. A shape or configuration detector 105 monitors whether or not section dimensions are within permissible tolerances so that the units 103 and/or 104 may control the bending force and/or displacement in response to the output signals of the detector 105. Alternatively the output signals of the detector 105 may be transmitted to the computer in order to correct the mathematical models or coefficients.

We claim:

1. A rolling mill comprising:

an upper and a lower work roll arranged to contact a strip or workpiece for rolling the same;

metal chock means for rotatably supporting each end of said upper and lower work rolls;

work roll bending means for applying a roll bending force interposed between the metal chock means of said upper work roll and the metal chock means of said lower work roll;

an upper and a lower backup roll arranged in a position outside of the associated upper and lower work rolls;

metal chock means for rotatably supporting each end of said upper and lower backup rolls;

an upper and a lower guide frame arranged in a position outside of each of said backup rolls on a side thereof remote from the associated work roll, said guide frames each extending over a width of respective roll surfaces of the upper and lower backup rolls at a spacing from the respective roll surfaces and contacting said metal chock means for said upper and lower backup rolls so as to transmit a rolling force applied to said upper and lower guide frames to said upper and lower backup rolls through said metal chock means for said backup rolls; and means for axially displacing said upper and lower backup rolls in an opposite direction to bring a side edge of an effective roll surface of the respective backup rolls substantially in vertical alignment with respective side edges of the strip or workpiece.

2. A rolling mill according to claim 1, wherein means are provided for connecting said upper and lower guide frames to said metal chock means for said backup rolls and to said axially displacing means so that said upper guide frame and said upper backup roll and said lower guide frame and said lower backup roll are each moved as a unit in the axial direction.

3. A rolling mill according to claim 1, wherein said upper and lower guide frames are stationarily positioned at the rolling mill, and wherein means are provided for connecting said axially displacing means to said upper and lower backup rolls.

* * * * *